US007118337B2

(12) United States Patent
Liang

(10) Patent No.: US 7,118,337 B2
(45) Date of Patent: Oct. 10, 2006

(54) GAS TURBINE AIRFOIL TRAILING EDGE CORNER

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 128 days.

(21) Appl. No.: 10/871,479

(22) Filed: Jun. 17, 2004

(65) Prior Publication Data

US 2005/0281671 A1 Dec. 22, 2005

(51) Int. Cl.
*F01D 5/18* (2006.01)

(52) U.S. Cl. ..... 416/1; 416/97 R

(58) Field of Classification Search ..... 416/1, 416/92, 97 R

See application file for complete search history.

(56) References Cited

U.S. PATENT DOCUMENTS

| | | | | |
|---|---|---|---|---|
| 4,601,638 | A | | 7/1986 | Hill et al. |
| 5,261,789 | A | | 11/1993 | Butts et al. |
| 6,059,530 | A | | 5/2000 | Lee |
| 6,164,913 | A | * | 12/2000 | Reddy ..... 416/97 R |
| 6,164,914 | A | | 12/2000 | Correia et al. |
| 6,174,135 | B1 | | 1/2001 | Lee |
| 6,179,565 | B1 | | 1/2001 | Palumbo et al. |
| 6,231,307 | B1 | | 5/2001 | Correia |
| 6,234,754 | B1 | | 5/2001 | Zelesky et al. |
| 6,328,531 | B1 | | 12/2001 | Bariaud et al. |
| 6,347,923 | B1 | | 2/2002 | Semmler et al. |
| 6,382,913 | B1 | | 5/2002 | Lee et al. |
| 6,551,062 | B1 | | 4/2003 | Leeke et al. |
| 6,609,891 | B1 | | 8/2003 | Leeke et al. |
| 6,616,406 | B1 | | 9/2003 | Liang |
| 6,652,235 | B1 | | 11/2003 | Keith et al. |
| 6,666,654 | B1 | | 12/2003 | Olhofer et al. |
| 6,672,829 | B1 | | 1/2004 | Cherry et al. |

* cited by examiner

*Primary Examiner*—Edward K. Look
*Assistant Examiner*—Richard A. Edgar

(57) ABSTRACT

A gas turbine airfoil (10) includes a pressure sidewall (12) and a suction sidewall (14) joined along respective leading (16) and trailing edges (18) and extends radially outward from a root (20) to a tip (22). The airfoil also includes a trailing edge corner (24) comprising a metering hole (36) receiving a cooling fluid flow (26) from an interior fluid flow channel (e.g., 32) and discharging a metered flow (40). A dispersion cavity (42) receives the metered flow and discharges a dispersed flow (44). The dispersion cavity includes a cross sectional area (46) greater than a cross sectional area (48) of the metering hole. An open flow channel (52) receives the dispersed flow and conducts the dispersed flow to a periphery (54) of the airfoil, the open flow channel controlling mixing of the cooling fluid flow with a process gas (e.g., 28) flowing around an exterior (34) of the airfoil.

15 Claims, 3 Drawing Sheets

GAS TURBINE AIRFOIL TRAILING EDGE CORNER

FIELD OF THE INVENTION

This invention relates generally to gas turbines engines, and, in particular, to an improved gas turbine airfoil trailing edge corner.

BACKGROUND OF THE INVENTION

Gas turbine airfoils exposed to hot combustion gases have been cooled by forming passageways within the airfoil and passing a cooling fluid through the passageways to connectively cool the airfoil. Such cooled airfoils may include a serpentine, multiple-pass flow path to provide sufficient convective cooling to maintain all portions of the airfoil at a relatively uniform temperature. In addition, the cooling fluid flow may be allowed to exit an interior of the airfoil at desired locations to provide film cooling of an external surface of the airfoil. One of the problems facing designers of airfoils exposed to hot combustion gases is that the airfoils need to be sufficiently strong to withstand forces applied to it during operation of the gas turbine, yet still retain an ability to be cooled effectively to prevent thermal fatigue. Reducing an amount of material used to form the airfoil, such as by making airfoil walls thinner, may reduce an amount of a cooling fluid flow required, but using less material to form the airfoil may adversely reduce a strength of the airfoil. Conversely, increasing an amount of material used to form the airfoil may make the airfoil stronger, but reduce the ability of the airfoil to be cooled sufficiently to prevent thermal fatigue. Furthermore, it is generally desired to keep the trailing edge of the airfoil relatively thin to achieve a desired aerodynamic efficiency. However, a thin trailing edge may increase the likelihood of failure of the trailing edge, for example, under the high centrifugal stresses imposed on it during turbine operation.

BRIEF DESCRIPTION OF THE DRAWINGS

The invention will be more apparent from the following description in view of the drawings that show.

DETAILED DESCRIPTION OF THE INVENTION

Figure 1:
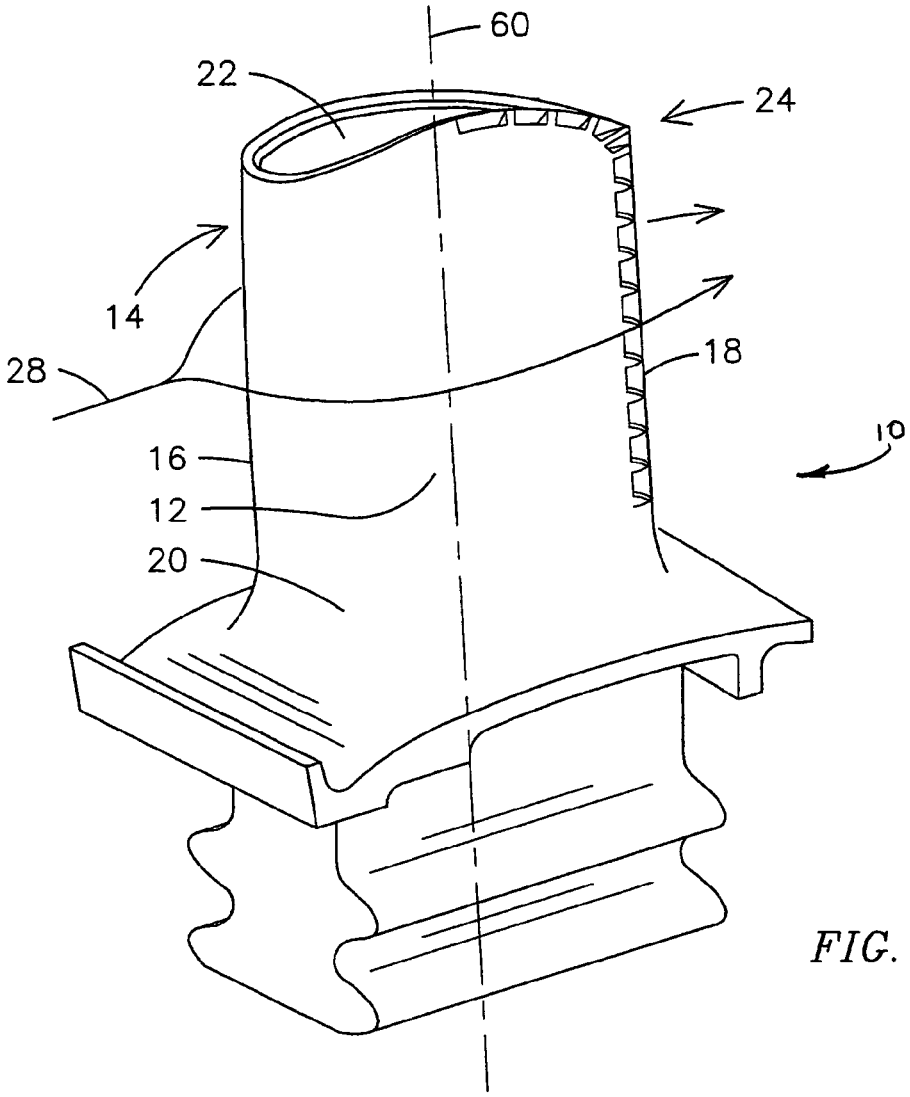
FIG. 1 is a perspective view of a turbine airfoil having an improved trailing edge corner configuration.
Figure 2:
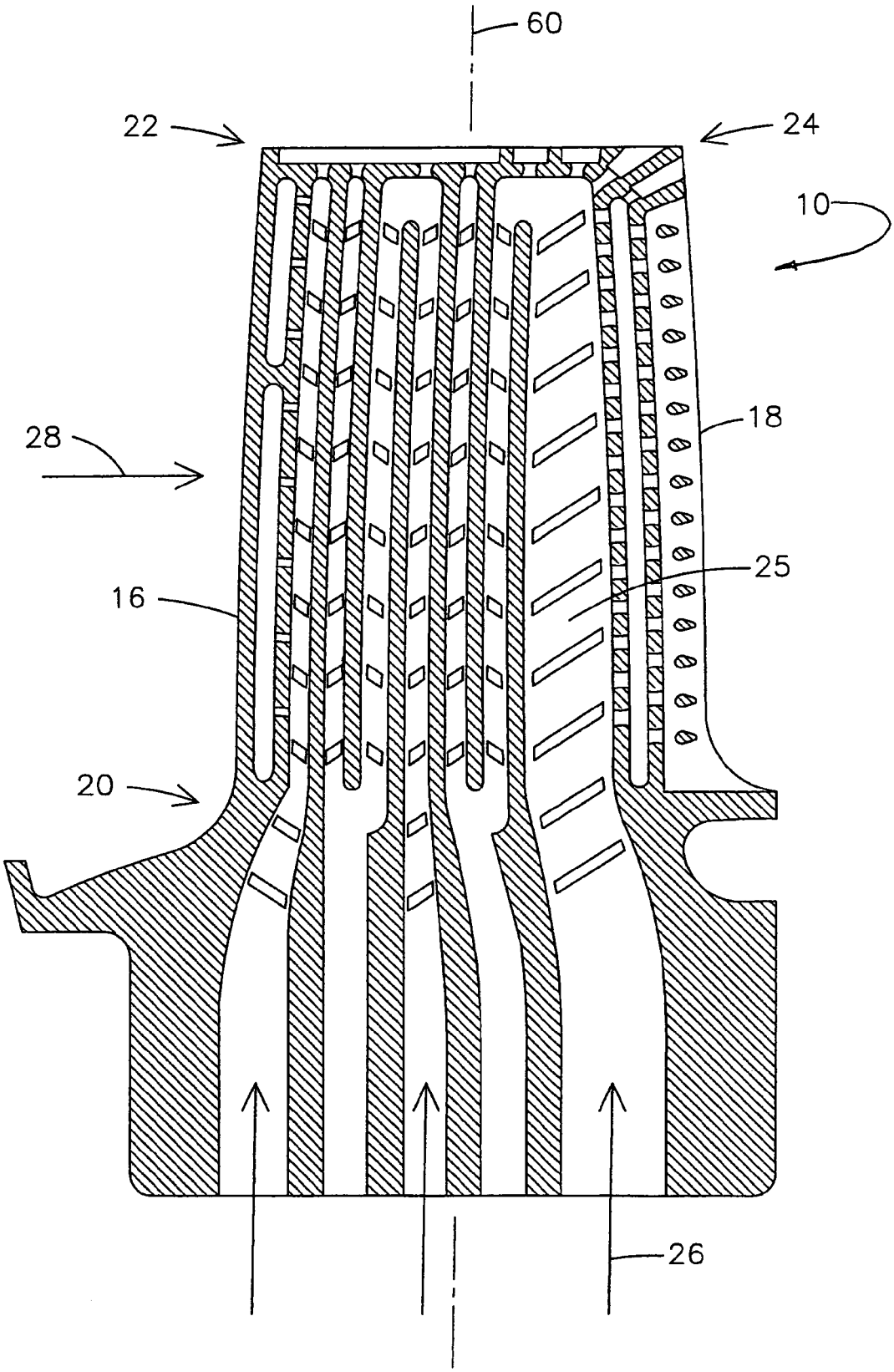
FIG. 2 is a cross-sectional view of the turbine airfoil of FIG. 1 taken along a radial axis of the airfoil.

FIG. 1 is a perspective view of a turbine airfoil 10 having an improved trailing edge corner configuration and FIG. 2 is a cross-sectional view of the turbine airfoil 10 of FIG. 1 taken along a radial axis 60 of the airfoil 10. Generally, the airfoil 10 includes a pressure sidewall 12 and a suction sidewall 14 joined along respective leading 16 and trailing edges 18 and extending radially outward from a root 20 to a tip 22. A trailing edge corner 24 defines an intersection of the trailing edge 18 and the tip 22. The airfoil 10 may include an internal serpentine cooling passage 25 having an inlet in the root 20 into which a cooling fluid flow 26 may be injected. During gas turbine operation, a hot combustion fluid flow 28 flows around an exterior of the airfoil 10.

To achieve aerodynamic efficiency, the trailing edge of a gas turbine airfoil is typically tapered to a relatively thin apex. However, the trailing edge of the airfoil, and, in particular, the trailing edge corner, is known to experience high vibratory stresses during turbine operation, conditions that may be exacerbated by a thinness of the trailing edge. To provide sufficient strength to withstand such stresses, the corner may be made thicker, but this may result in prohibitive aerodynamic losses and make it more difficult to sufficiently cool the tip due to an increased thermal mass of the corner compared to a thinner configuration. The inventor of the present invention has developed a cooled gas turbine airfoil having an innovative trailing edge corner configuration that provides improved cooling of the trailing edge corner while retaining a desired aerodynamic efficiency and sufficient strength to withstand the forces applied to it during turbine operation.

Figure 3:
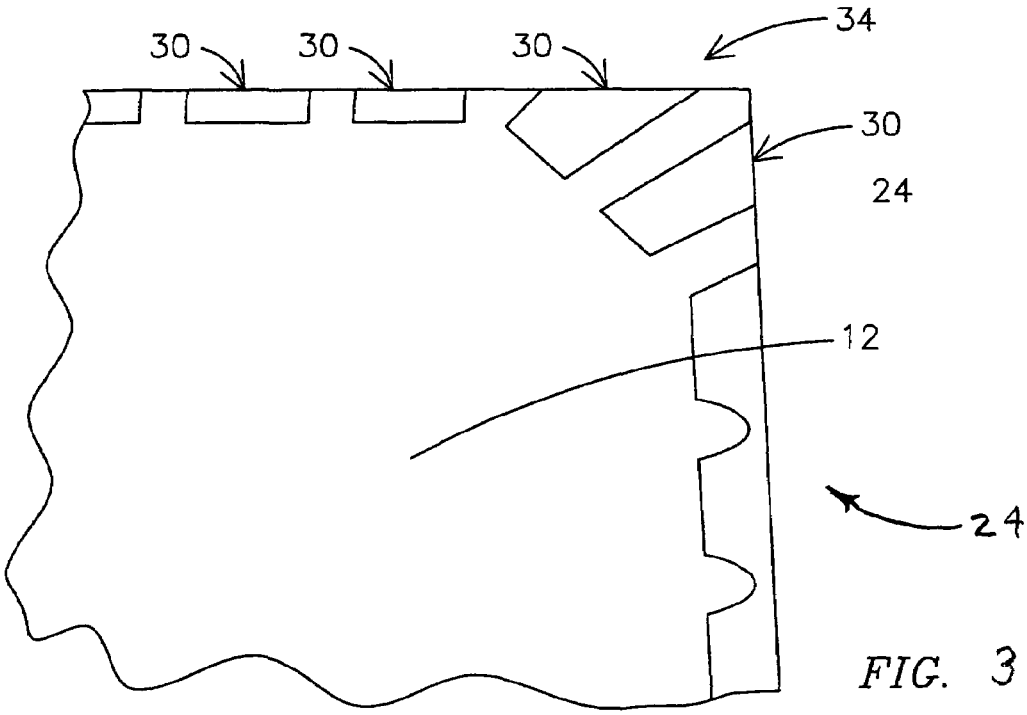
FIG. 3 is a partial cutaway view of the trailing edge corner of the turbine airfoil of FIG. 1.
Figure 4:
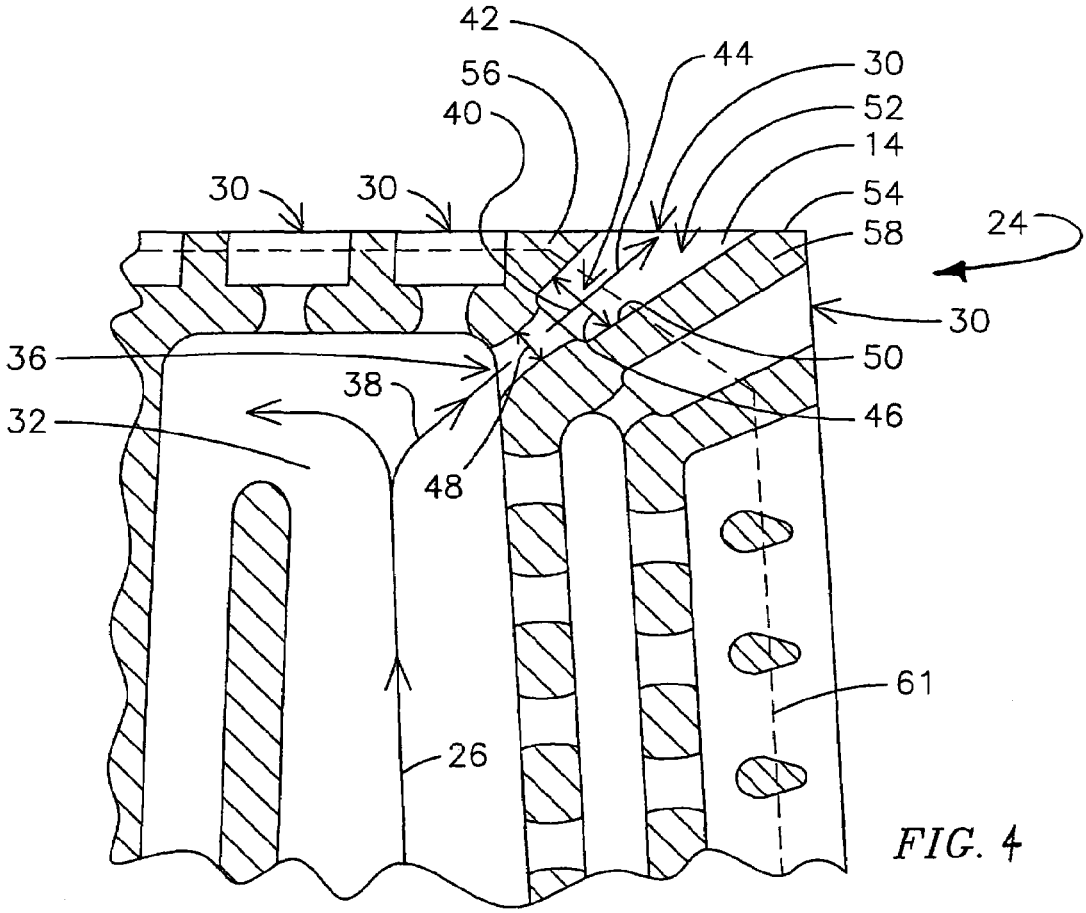
FIG. 4 is a partial cutaway view of the trailing edge corner of the turbine airfoil of FIG. 1 with the pressure sidewall removed.

FIG. 3 is a partial cutaway view of a trailing edge corner 24 of the turbine airfoil 10 of FIG. 1, while FIG. 4 shows a partial cutaway view of the trailing edge corner 24 with the pressure sidewall 12 removed. Generally, the innovative trailing edge corner configuration includes a cooling fluid flow conduit 30 extending from an interior cooling flow path, such as a serpentine cooling passage 32, of the airfoil to an exterior 34 of the airfoil 10. The conduit 30 may include a metering hole 36 at an inlet end, a dispersion cavity 42 in a first region, and an open flow channel 52 in a second region, and may be configured to have a reduced mass of the trailing edge corner 24 compared to conventional airfoils (thereby increasing an ability to cool the corner 24), while still retaining sufficient structural strength to withstand forces applied to the airfoil 10 during turbine operation. The metering hole 36 receives a portion of the cooling fluid flow 26 from the serpentine cooling passage 32 of the airfoil 10 and discharges a metered flow 40 into the dispersion cavity 42. The dispersion cavity 42 receives the metered flow 40 and discharges a dispersed flow 44. In an aspect of the invention, the dispersion cavity 42 is sized with respect to the metering hole 36 to achieve a dispersion of the metered flow 40 over a desired internal surface portion 50 of the cavity 42 to provide cooling of the surface portion 50. It has been experimentally determined that a cross-sectional area ratio (measured, for example, perpendicular to a direction of flow) between the dispersion cavity 42 and the metering hole 36 of about two to five provides sufficient dispersion of a cooling flow to cover the internal surface 50 of the cavity. Accordingly, the dispersion cavity 42 may be configured to have a cross-sectional area 46 greater than a cross sectional area 48 of the metering hole 36, and the ratio of the cross sectional areas 46, 48 may be selected to be in the range of two to five. In a further aspect of the invention, the dispersion cavity 42 may be defined by a pair of spaced apart ribs 56, 58 extending in a flow direction of the dispersed flow 44, by the suction sidewall 14 spanning between the ribs 56, 58 on one side of the cavity 42, and by the pressure sidewall 12 (indicated by dashed line 61) on an opposite side of the cavity 42.

An open flow channel 52, in fluid communication with the dispersion cavity 42, receives the dispersed flow 44 and conducts the dispersed flow 44 to a periphery 54 of the airfoil 10. The flow channel 52 may be open on one side of the airfoil 10 and exposed to the hot combustion fluid flow 28 flowing around the exterior of airfoil 10. The open flow channel 52 may be configured to control mixing of the dispersed flow 44 with the hot combustion fluid flow 28, so that the dispersed flow 44 is protected from mixing with the hot combustion fluid flow 28 to provide desired cooling of the airfoil proximate the flow channel 52. In an aspect of the invention, the open flow channel 52 may be defined by the pair of spaced apart ribs 56, 58 extending from the dispersion cavity 42 in a flow direction of the dispersed flow 44 and by the suction sidewall 14 spanning between the ribs 56, 58 on one side of the flow channel 52. Accordingly, the flow channel 52 remains open on a pressure side of the airfoil 10. Advantageously, the ribs 56, 58 provide structural rigidity to the trailing edge corner 24 and help protect the flow 44 from being disturbed by the hot combustion gases 28. In addition, instead of having a flow channel bounded completely on all sides, the amount of material used in the trailing edge corner 24 may be reduced by leaving a side of the flow channel 24 open (thereby reducing a cooling demand compared to a completely enclosed channel), so that the dispersed flow 44 remains sufficiently protected by the ribs and suction sidewall 14 to cool the airfoil in the vicinity of the flow channel 52.

In an aspect of the invention, the ribs 56, 58 may extend at an oblique angle away from a radial axis 60 of the airfoil. For example, the ribs may extend at an angle of between 30 to 60 degrees away form the radial axis 60. A rib 56, 58 geometry, such as a cross-sectional area of the rib, a length of the rib, and a spacing between adjacent ribs, may be selected to achieve a desired rigidity of the trailing edge corner 24 effective to control vibration of the trailing edge corner 24 during turbine operation and to control a flow of the dispersed flow 44. In another aspect, a plurality of adjacent conduits 30 may formed in the trailing edge corner 24 and adjacent portions of the airfoil, such as the tip 22 and trailing edge 18, to provide a desired level of cooling and structural rigidity of the trailing edge corner 24.

Figure 5:
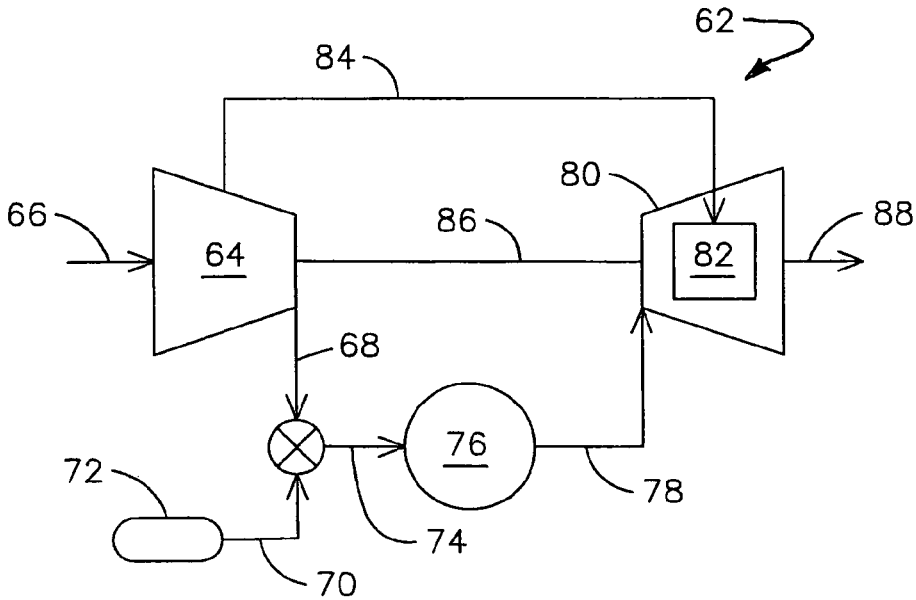
FIG. 5 is a functional diagram of a combustion turbine engine having a turbine including an airfoil of the current invention.

FIG. 5 illustrates a gas turbine engine 62 including an exemplary cooled airfoil 82 as described herein. The gas turbine engine 62 may include a compressor 64 for receiving a flow of filtered ambient air 66 and for producing a flow of compressed air 68. The compressed air 68 is mixed with a flow of a combustible fuel 70, such as natural gas or fuel oil, provided, for example, by a fuel source 72, to create a fuel-oxidizer mixture flow 74 prior to introduction into a combustor 76. The fuel-oxidizer mixture flow 74 is combusted in the combustor 76 to create a hot combustion gas 78.

A turbine 80, including the airfoil 82, receives the hot combustion gas 78, where it is expanded to extract mechanical shaft power. In an aspect of the invention, the airfoil 82 is cooled by a flow of cooling air 84 bled from the compressor 64 using the technique of providing a metering hole, a dispersion cavity, and an open flow channel in a trailing edge corner of the airfoil 82 as previously described. In one embodiment, a common shaft 86 interconnects the turbine 64 with the compressor 80, as well as an electrical generator (not shown) to provide mechanical power for compressing the ambient air 66 and for producing electrical power, respectively. The expanded combustion gas 88 may be exhausted directly to the atmosphere or it may be routed through additional heat recovery systems (not shown).

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A gas turbine airfoil comprising:

a pressure sidewall and a suction sidewall joined along respective leading and trailing edges and extending radially outward from a root to a tip;

a trailing edge corner defining an intersection of the trailing edge and the tip; the trailing edge corner comprising:

a metering hole receiving a cooling fluid flow from an interior fluid flow channel of the airfoil and discharging a metered flow;

a dispersion cavity receiving the metered flow and discharging a dispersed flow, the dispersion cavity having a cross sectional area greater than a cross sectionnal area of the metering hole, said dispersion cavity being defined by a pair of spaced apart ribs extending in a flow direction of the dispersed flow, by the suction sidewall spanning between the ribs on one side of the cavity, and by the pressure sidewall on an opposed side of the cavity;

an open flow channel receiving the dispersed flow and conducting the dispersed flow to a periphery of the airfoil, the open flow channel controlling mixing of the cooling fluid flow with a process gas flowing around an exterior of the airfoil.

2. The gas turbine airfoil of claim 1, further comprising the open flow channel defined by the pair of spaced apart ribs extending from the dispersion cavity in a flow direction of the dispersed flow and by the suction sidewall spanning between the ribs on the one side of the flow channel.

3. The gas turbine airfoil of claim 1, wherein the pair of ribs extend at an oblique angle away from a radial axis of the airfoil.

4. The gas turbine airfoil of claim 3, wherein the oblique angle is between 30 and 60 degrees.

5. The gas turbine airfoil of claim 1, wherein a ratio of the cross sectional area of the dispersion cavity and the cross sectional area of the metering hole is selected to produce a desired dispersion of the metered flow into the cavity.

6. The gas turbine airfoil of claim 5, wherein the ratio is from two to five.

7. A gas turbine comprising the airfoil of claim 1.

8. A method of cooling a trailing edge corner of a gas turbine airfoil comprising:

disposing a cooling fluid flow conduit between an interior of the airfoil and an exterior of the airfoil proximate the trailing edge corner;

providing a metering hole at an inlet of the conduit for receiving a cooling fluid flow;

expanding the cooling fluid flow from the metering hole into a first region of the conduit, the first region having a cross sectional area greater than a cross sectional area of the metering hole;

confining the cooling fluid flow in the first region by a pair of spaced apart ribs extending in a flow direction of the dispersed flow, by a suction sidewall spanning between the ribs on one side of the region, and by a pressure sidewall on an opposite side of the region;

directing the cooling fluid flow into an open channel in a second region of the conduit downstream of the first region to control mixing of the cooling fluid flow with a process gas flowing around the exterior of the airfoil.

9. The method of claim 8, further comprising confining the fluid flow between the two spaced apart ribs extending from the first region and by the suction sidewall of the airfoil spanning between the ribs on one side of the open channel so that a surface of the flow opposite the suction sidewall is exposed to the process gas flowing around a pressure sidewall of the airfoil.

10. The method of claim 9, further comprising selecting a rib geometry to achieve a rigidity of the trailing edge corner effective to control vibration of the trailing edge corner during turbine operation.

11. The method of claim 10, wherein the rib geometry is selected from the group consisting of a cross-sectional area of the rib, a length of the rib, and a spacing between adjacent ribs.

12. The method of claim 8, further comprising selecting a ratio of the cross sectional area of the first region and the cross sectional area of the metering hole to produce a desired dispersion of the cooling fluid flow into the first region.

13. The method of claim 12, wherein the ratio is from two to five.

14. The method of claim 8, further comprising orienting the conduit at an oblique angle to an axis of the airfoil.

15. The method of claim 14, wherein the oblique angle is between 30 and 60 degrees.

* * * * *